US006026770A

United States Patent [19]

Ueda et al.

[11] Patent Number: 6,026,770

[45] Date of Patent: Feb. 22, 2000

[54] CARBURETOR FOR TWO-CYCLE ENGINE

[75] Inventors: Minoru Ueda; Hideaki Andoh, both of Saitama, Japan

[73] Assignee: Honda Giken Kogyo Kabushiki Kaisha, Tokyo, Japan

[21] Appl. No.: 09/037,517

[22] Filed: Mar. 10, 1998

[30] Foreign Application Priority Data

Mar. 10, 1997 [JP] Japan ..... 9-072660

[51] Int. Cl.[7] ..... F02B 33/04

[52] U.S. Cl. ..... 123/73 AD; 123/196 R

[58] Field of Search ..... 123/196 R, 73 AD

[56] References Cited

U.S. PATENT DOCUMENTS 5,195,481 3/1993 Oyama et al. ..... 123/196 R

FOREIGN PATENT DOCUMENTS 7071279 3/1995 Japan .

7180556 7/1995 Japan .

*Primary Examiner*—Noah P. Kamen

*Attorney, Agent, or Firm*—Birch, Stewart, Kolasch & Birch, LLP

[57] ABSTRACT

To provide a carburetor for a two-cycle engine, and prevent water from entering into the engine, using a lubricating system of the engine. Oil sealing members are attached to bearings of a throttle shaft of a carburetor. Oil holes are formed at positions near a barrel passage and inside the oil sealing members, thereby forcibly supplying lubricating oil to the bearings. Therefore, the bearing are continuously lubricated, so that water is prevented from entering into the carburetor. The forcibly supplied lubricating oil leaks from the bearings to the barrel passage, and is supplied to the interior of the engine together with air-fuel mixture produced by the carburetor. The two oil holes communicate with each other via a dovetail groove, so that the lubricating oil from a lubricating oil plug is simultaneously supplied to the bearings at the opposite ends of the throttle shaft.

21 Claims, 7 Drawing Sheets

CARBURETOR FOR TWO-CYCLE ENGINE

BACKGROUND OF THE INVENTION

1. Field of the Invention

The present invention relates to a structure for the bearings of a throttle shaft in a carburetor, and particularly to a carburetor that mixes lubricating oil with an air-fuel mixture supplied to a combustion chamber in order to lubricate respective parts of the engine.

2. Description of Background Art

An engine is provided with a carburetor for charging air with a spray of liquid fuel, and an engine speed is changed by varying the amount of the opening of a throttle valve of the carburetor.

The carburetor includes the throttle valve that is positioned in a barrel, and can be freely opened or closed via a throttle shaft. In response to the rider's throttle operation, the throttle shaft is turned, so that the carburetor changes the opening amount of the throttle valve, and controls the amount of an air-fuel mixture to be supplied to the engine.

This carburetor is usually applied to various kinds of engines. For instance, it is used for supplying the air-fuel mixture to a compact and high output two-cycle engine in a motorcycle, a small leisure boat, or the like.

In the foregoing engine, various measures such as sealing members have been provided in order to prevent water from entering into the engine. Specifically, such measures are essential in a motorcycle whose engine is often exposed to rainwater or a boat whose engine is affected by bilge.

However, the carburetor includes a throttle shaft which is rotatably attached to its body and is connected to a throttle wire for transmitting a throttle operation force, and an accelerating pump operating in response to the rotation of the throttle shaft. The throttle shaft has to be exposed from the carburetor body. Therefore, even when sealing members are attached to bearings of the throttle shaft, external water may enter into the carburetor via clearances that are caused by the rotating throttle shaft and the bearings. This means that water enters into the engine together with an air-fuel mixture.

The foregoing situation will be described in detail with reference to a carburetor for a two-cycle boat engine.

In a small leisure boat or the like, water usually enters into an engine room since water is splashed while propelling the boat through the water. Therefore, water tends to enter into the bearings of the throttle shaft not only from the exterior but also from the interior (i.e., a barrel passage), which often causes the bearings to rust or to become clogged with the salt that is in seawater.

In order to overcome the foregoing problem, sealing members are usually attached to the bearings. When the sealing members are simply provided on an outer side of the bearings, it is impossible to prevent water, which is contained in the intake air, from entering into the bearings of the throttle shaft from the barrel passage (from the interior), because of capillary action. Therefore, the bearings have to be protected at the inner and outer sides by sealing members. Once such a sealing structure is utilized, water that is already present in the bearings, cannot be removed. This means that the bearings easily gather rust.

Under the foregoing situation, carburetors for small boats do not usually have the sealing members. Large clearances are provided in the bearings in order to allow water to leave from the bearings.

However, when the bearings have large clearances, the throttle shaft is very shaky when it turns, which means that the carburetor tends to control the amount of fuel to be supplied to the engine with reduced precision, and becomes less durable. Further, it is necessary to precisely control the amount of fuel to be supplied in order to promote exhaust purification, but it difficult for such a carburetor to meet this requirement.

SUMMARY AND OBJECTS OF THE INVENTION

The present invention has been conceived in order to overcome the foregoing problems of the related art, and is intended to provide a carburetor which can prevent water from entering into the carburetor via bearings of a throttle valve, using a special oil supplying system of a two-cycle engine.

Further, the invention is intended to provide a carburetor for a two-cycle engine, which has clearances around the bearings, and can not only precisely control the amount of fuel to be supplied to the engine but can also prevent water from entering into the bearings using lubrication oil in the engine.

In order to accomplish the foregoing objects, the present invention is intended to provide a carburetor for a two-cycle engine, in which sealing members are attached to bearings of a throttle shaft in order to keep the bearings liquid-tight, and oil holes are formed at positions near barrel passages and inside the sealing members in order to forcibly supply lubrication oil to the bearings via the oil holes.

The carburetor includes parts located inside the bearings that are continuously filled with the lubricating oil. Even if clearances are caused around the sealing members by the rotating throttle shaft, external water is prevented from entering into the carburetor by a film of the lubricating oil. Further, the forcibly supplied lubricating oil leaks to the barrel passage from the bearings, and is supplied to the interior of the engine together with air-fuel mixture, thereby lubricating the cylinders.

In the carburetor for the two-cycle engine, the oil holes are formed for the bearings supporting opposite ends of the throttle shaft, a dovetail groove is formed on a flange of the carburetor for attachment to the engine, and one end of each of the oil holes communicates with the dovetail groove in order to forcibly supply lubricating oil from an external source and lubricate the bearings.

It is therefore possible to supply the lubricating oil to the bearings at the opposite ends of the throttle shaft from one source.

In the carburetor for the two-cycle engine, the lubricating oil is a separate supply oil which is mixed with an air-fuel mixture supplied to a combustion chamber via the barrel passage and is supplied to respective members of the engine.

The lubricating oil not only lubricates and waterproofs the bearings but also lubricates respective parts of the engine.

Further, in the carburetor for the two-cycle engine, the lubricating oil is supplied by an oil pump that varies an amount of the lubricating oil in accordance with an engine speed.

The higher the engine speed, the more the lubricating oil will be supplied to the engine depending upon the operation thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The invention will be described with reference to an embodiment in which a carburetor is applied to a two-cycle engine, as shown in the accompanying drawings.

In this embodiment, the carburetor is applied to a three-cylinder two-cycle engine for a jet-propelled boat on which an operator sits astride.

Figure 1:
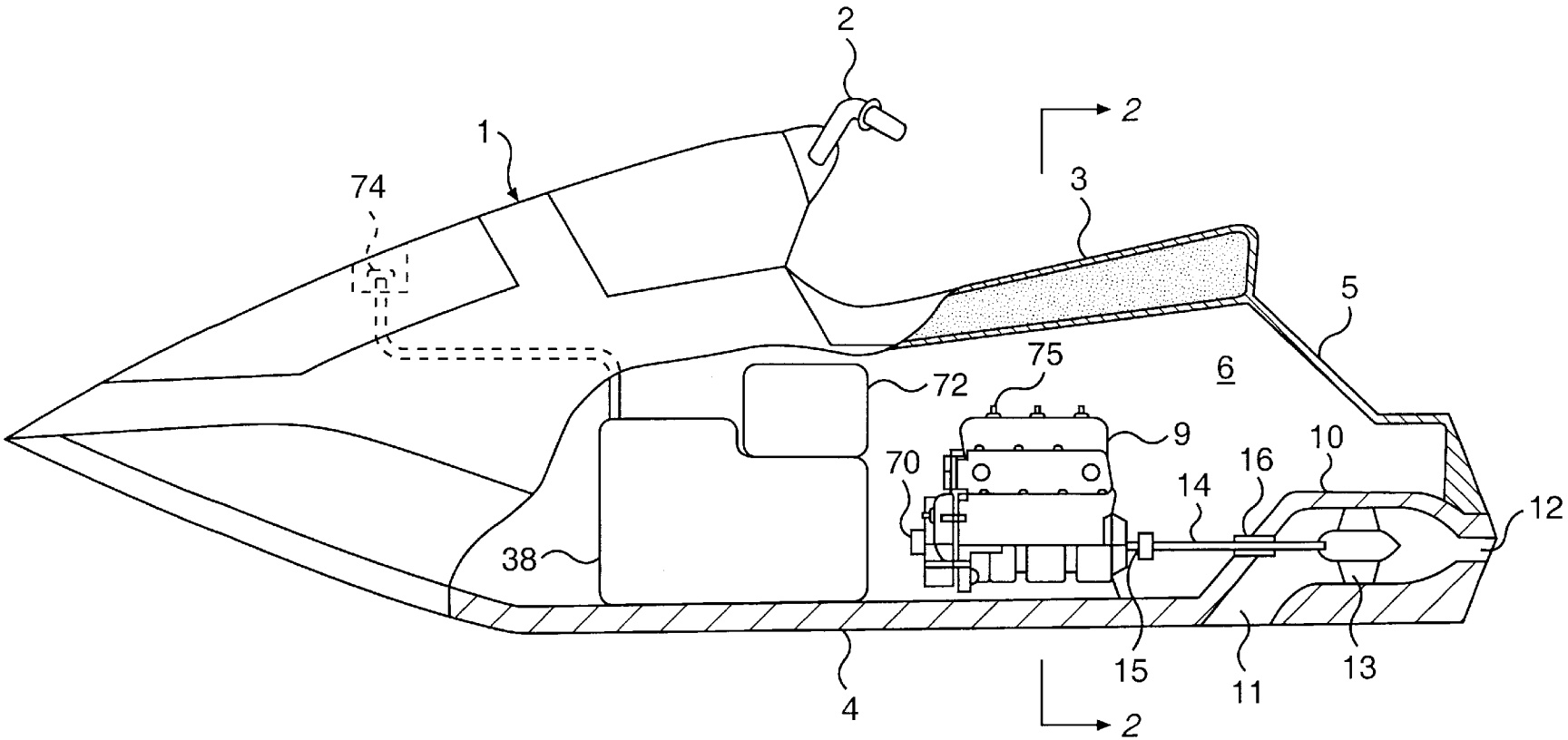
FIG. 1 is a side and partly cross-sectional view, of a jet-propelled boat according to one embodiment of the invention.

As illustrated in FIG. 1, a body 1 of the jet-propelled boat includes a steering handle 2 substantially at its center, and a seat 3 in the shape of a saddle that is behind the steering handle 2. The operator rides astride the seat 3 (with his or her feet maintained on footrests shown in FIG. 2), and operates the steering handle 2 in order to propel the boat.

The boat body 1 comprises a lower panel 4 and an upper panel 5 that are made of reinforced plastic (FRP) or the like, and are joined from both upper and lower sides. A vacant space 6 is defined by the upper and lower panels, so that the boat has a buoyant structure. The foot rests 7 are positioned at opposite sides of the seat 3 on the upper panel 5. A part of the space 6 under the foot rests 7 houses a buoyant float 8.

A power unit mainly comprising a two-cycle engine 9 is housed in the space 6 in the boat body 1. Specifically, the space 6 for housing the engine 6 is defined under the seat 3, and is relatively narrow in view of the center of gravity for assuring a good steering feeling and a positional relationship with a jet propeller 10 which is present at a rear end of the boat body 1.

The jet propeller 10 forms a channel from a water inlet 11 on a bilge of the boat to a jet nozzle 12 which opens at the rear end of the boat, and houses an impeller 13 which is rotatable in the channel. The impeller 13 is connected to an output shaft 15 of the engine 9 via a drive shaft 14. In FIG. 1, a sealing member 16 is provided for maintaining the drive shaft 14 in a water-tight manner and enabling the drive shaft 14 to be freely rotatable.

When the engine 9 rotates the impeller 13, water introduced via the water inlet 11 is ejected, with a gush, via the jet nozzle 12, thereby propelling the boat 1 forward.

The engine 9 is a two-cycle engine in which three cylinders are arranged in parallel with one another with respect to a crankshaft. The engine 9 is housed in the space 6 which is substantially in the shape of an inverted cone, and is present under the seat 3, with the crankshaft extending forwardly and rearwardly along the length of the body 1, with the axes of the cylinders oriented toward the apex of the bilge in the shape of an inverted cone.

As shown in detail in FIGS. 3 and 4, the engine 9 is mounted in the body 1 in the following manner. A cylinder block 24 and a cylinder head 25 are stacked on the crankcase 23 one over another so as to form one integral unit. The crankcase 23 is attached to an engine hanger 26, which is engaged via a mounting block 27 with bosses 28 formed on the lower panel 4.

Pistons 30 are slidably fitted in three cylinder holes 29 on the cylinder block 24. Each piston 30 is coupled to the crankshaft 31 via a connecting rod 32. The crankshaft 31 is rotated in response to the upward and downward movements of the pistons 30, so that the rotating force of the crankshaft 31 is transmitted from the output shaft 15 in order to rotate the impeller 13.

Air intake ports 33 are formed on one side of the cylinder block 24 (i.e., on the left side in FIG. 2), and are provided for the respective cylinders. The air intake ports 33 include reed valves 34 therein, and are connected to carburetors 36, via an intake manifold 35. An air cleaner 37 is positioned upstream of the carburetors 36. Fuel is supplied to the carburetors 36 from a fuel tank 38.

The operation of a throttle lever (not shown) connected to the steering handle 2 controls an opening amount of the throttle valves of the carburetors 36, and allows the air from the air cleaner to be mixed with the fuel in the carburetors 36. Then, an air-fuel mixture is supplied to the crankcase 23 via the reed valves 34 and the intake manifold 35.

Exhaust ports 39 are provided on the other side of the cylinder block 24 (i.e., the right side in FIG. 2), and are provided for the respective cylinders. Exhaust control valves 40 are provided in the exhaust ports 39. The exhaust control valves 40 are positioned near an exhaust outlet confronting the cylinder holes 29, which are capable of pivoting or swinging, and are activated by a cylinder device in accordance with a speed of the jet boat as described later. Each exhaust control valve 40 controls an open area of each exhaust port 39 in order to enable each exhaust port 39 to discharge exhaust gases most efficiently in accordance with the operation of the jet boat. Specifically, the exhaust ports 39 are closed in order to promote combustion under active and hot ambiance when the jet boat is running at a low speed or under a low load, thereby improving fuel economy and promoting exhaust purification.

The combustion in the active and hot ambiance is also referred to as "AR combustion." As disclosed in Japanese Patent Laid-Open Publications No. Hei 7-71279 and No. Hei 7-180556, an exhaust control valve for opening and closing an exhaust port is disposed on an inner wall of an exhaust passage near an upper edge of the exhaust port. When the two-cycle engine is operating at a low speed or under a low load, the exhaust port is substantially closed in order to precisely control a pressure inside the cylinders, activated fresh air in the combustion chamber by using thermal energy of already burnt gases remaining in the combustion chamber causes self-ignition to be performed, improve fuel economy, and purify exhaust gases.

The exhaust ports 39 are connected to an exhaust manifold 41, and are collectively connected to an exhaust chamber 42 via the exhaust manifold 41. The exhaust chamber 42 is connected to a muffler (not shown) at the rear end of the boat body. Exhaust gases from the exhaust ports 39 are discharged out of the boat body 1 via the exhaust manifold 41, exhaust chamber 42, and the muffler.

In this embodiment, the exhaust manifold 41 opens towards the bow (to the left in FIG. 1) of the boat body 1, and the exhaust chamber 42 is connected to an open end of the exhaust manifold 41. The exhaust chamber 42 is formed upwardly, and then extends rearwardly to come into contact with the muffler.

Figure 4:
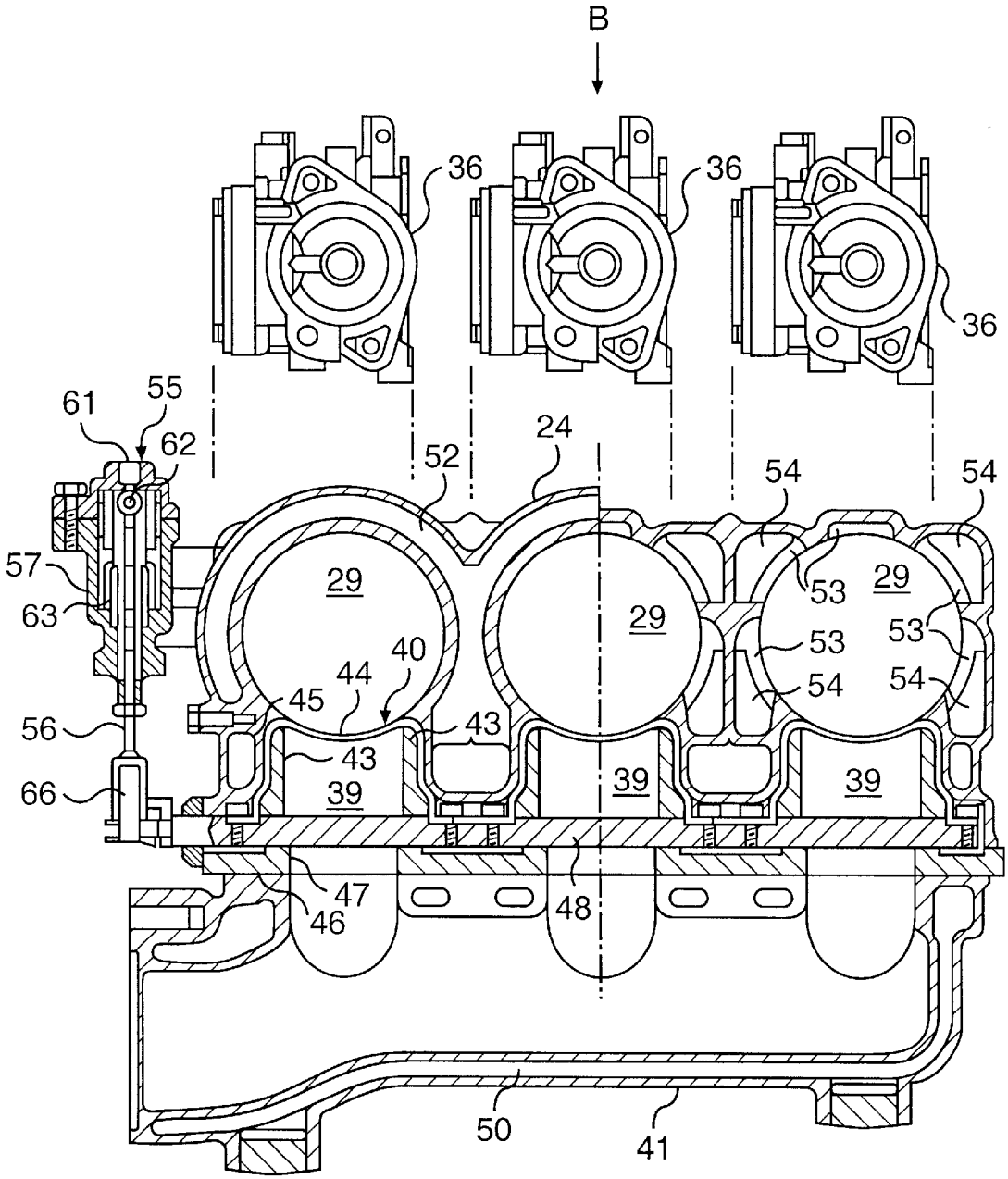
FIG. 4 shows a lateral cross section of the two-cycle engine showing the arrangement of the carburetors in the engine.

Referring to FIG. 4, each exhaust control valve 40 comprises a pair of plates 43 substantially in the shape of a sector and a valve plate 44 whose cross section is in the shape of an arc. Each plate 43 is coupled to the valve plate 44 at its edges. Each exhaust control valve 40 is housed in a cavity 45 which is positioned along the upper edges of the exhaust ports on the cylinder block 24, and is in the shape of an arc in a longitudinal cross section. A bracket 46 for supporting the exhaust control valves 40 is interposed and fixed between the cylinder block 24 and the exhaust manifold 41. The support bracket 46 has through-holes 47 for enabling the exhaust ports 39 to communicate with the exhaust manifold 41. Further, the support bracket 46 rotatably supports a pivot 48 extending between the cylinders. Bases of the plates 41 of the exhaust control valves 40 are fixed to the pivot 48 using small screws.

The axial rotation of the pivot 48 supporting the exhaust control valves 40 enables opening and closing of the exhaust control valves 40, so that an opening ratio of the exhaust ports 39 is variable between a substantially fully closed and a substantially fully opened position.

Figure 2:
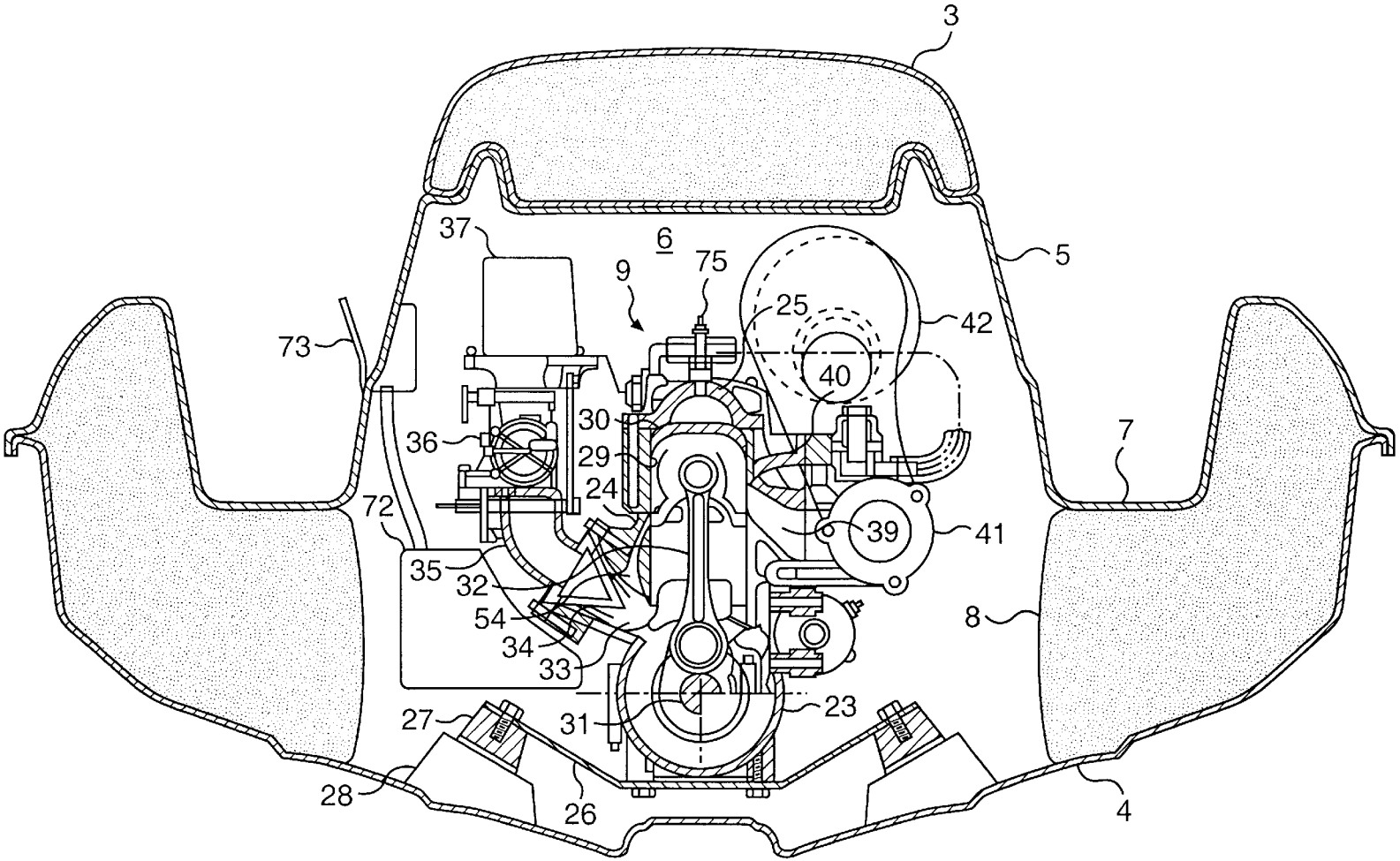
FIG. 2 is a cross sectional view observed along line 2—2 in FIG. 1.

The exhaust passage extending from the exhaust ports 39 is formed downwardly towards the exhaust manifold 41 in order to detour the upper edge of the exhaust ports 39, as shown in FIG. 2. Therefore, the pivot 48 can be arranged across the exhaust ports 39.

Referring to FIG. 4, the exhaust manifold 41 is provided with a water jacket 50 through which cooling water flows. Further, the cylinder block 24 also includes a water jacket 52 communicating with the water jacket 50 via a pipe in order to introduce the cooling water.

Five scavenging ports 53 are formed above each cylinder hole 29, with each scavenging port 53 communicating with an interior of the crankcase 23 via a scavenging path 54 longitudinally passing through the cylinder block 24.

The two-cycle engine performs the scavenging operation in the following manner. Specifically, the air-fuel mixture supplied to the crankcase 23 from the carburetors 36 is compressed by the downward movement of the pistons 30, and is supplied under pressure to the combustion chambers of the cylinders via scavenging paths 54 and the scavenging ports 53.

Referring to FIG. 4, the cylinder device 55 is attached to an outer side wall of the cylinder block 24, and has a tip of its piston rod 56 coupled to the pivot 48 of the exhaust control valves.

The cylinder device 55 comprises a piston 59 housed in a cylinder body 57 via a diaphragm so as to swing freely. The piston rod 56 projecting from the cylinder body 57 is attached to the piston 59.

The cylinder body 57 is provided with an intake port 61 for supplying liquid to a pressure chamber with which a pressure receiving area of the piston 59 confronts, a discharge port 62 for discharging the liquid from the pressure chamber, and a return spring 63 for urging the piston 69 against water pressure from the pressure chamber. Therefore, when the water pressure above a predetermined value is applied to the pressure chamber, the piston 59 moves against the return spring 63 in order to project the piston rod 56. Conversely, when the water pressure is reduced below the predetermined value, the piston 59 retracts the piston rod 56 in response to the resilience of the return spring 63.

The piston rod 56 is coupled via its tip to a lever 66 attached to one end of the pivot 48, so that the lever 64 as well as the pivot 48 is rotated in response to the movement of the piston rod 56. In other words, if the water pressure exceeding the predetermined value is applied to the pressure chamber and the piston rod 56 projects, the lever 66 is rotated so as to enable the exhaust control valves 40 to fully open the exhaust ports 39. Conversely, if the water pressure is reduced below the predetermined value and the piston rod 56 is retracted, the lever 66 is reversibly rotated, and the exhaust control valve 40 closes the exhaust ports 39 substantially fully.

In this embodiment, water pressurized by the jet propeller 10 is supplied to the pressure chamber of the cylinder device 55. The faster the impeller 13 is rotated, the higher the pressure of the water is raised, so that the exhaust control valves 40 are operated to open the exhaust ports 39 fully (i.e., 100%). Conversely, if the impeller 13 is rotated at a moderate speed (i.e., when the engine is operating at a low speed or under a low load), the pressure of the water applied to the pressure chamber is relatively low. In this state, the return spring 63 urges the exhaust control valves 40 to close, thereby substantially closing the exhaust ports 39, and putting the engine in the AR combustion state.

Figure 3:
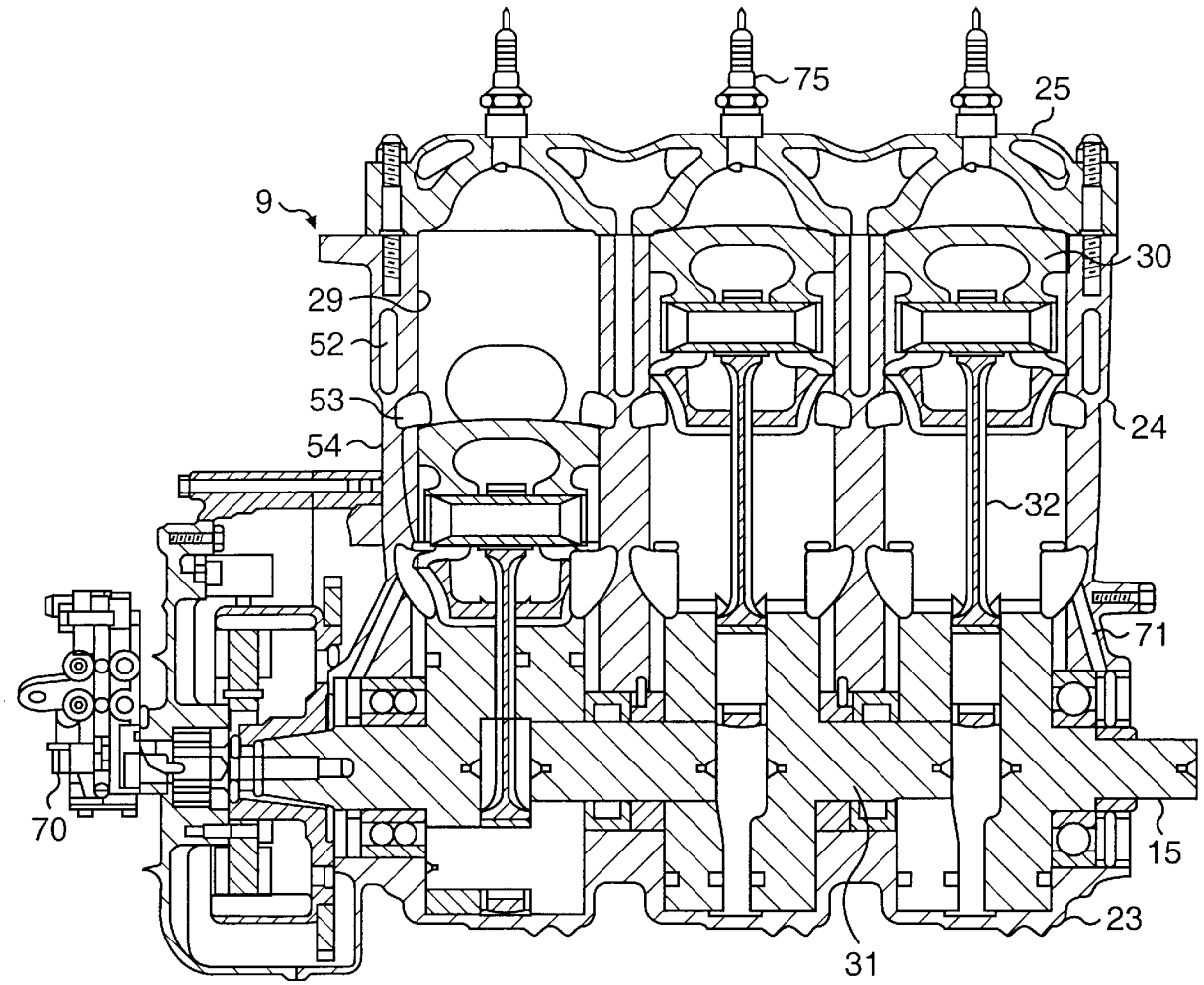
FIG. 3 is a longitudinal cross-sectional view of a two-cycle engine to which the invention is applicable.

As shown in FIG. 3 in detail, an oil pump 70 is connected to one end of the crankshaft 31 of the engine 9. The oil pump 70 is activated in response to the rotation of the crankshaft 31, and supplies pressurized lubricating oil from a lubricating oil tank 72 to respective parts of the engine 9 via oil paths 71 or the like formed in the cylinder block 24 and so on. This lubricating oil from the oil pump 70 is also supplied to the carburetors 36 as described later. After lubricating the bearings of the carburetors 36, the lubricating oil is made to drip into the barrel passage, and is supplied to the engine parts together with the air-fuel mixture. The lubricating oil is supplied under pressure by the oil pump 70 activated by the engine 9, so that the higher the engine speed, the more lubricating oil is supplied to the engine. Alternatively, the amount of lubricating oil supplied by the oil pump 70 may be separately controlled in a stepwise manner.

In FIG. 2, an oil lid 73 is provided for supplying the lubricating oil to the lubricating tank 72. As illustrated in FIG. 1 a fuel lid 74 is mounted on the supply line for supplying the fuel to the fuel tank 38. In FIGS. 1 and 3, spark plugs 75 are provided for the respective cylinders, and are used to ignite the compressed gas in the combustion chambers.

Figure 5:
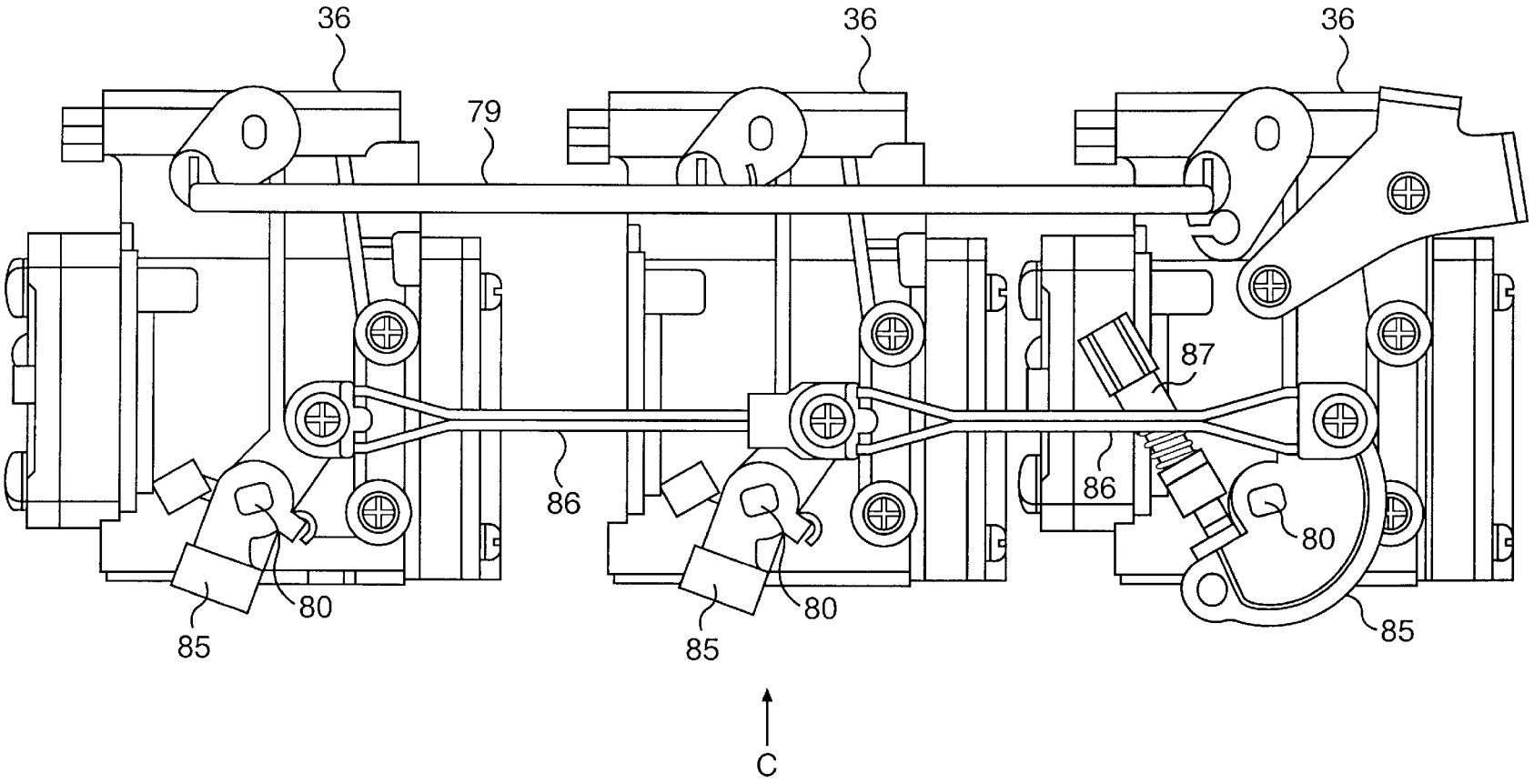
FIG. 5 is a side view of the carburetors, observed in the direction of arrow B in FIG. 4.
Figure 6:
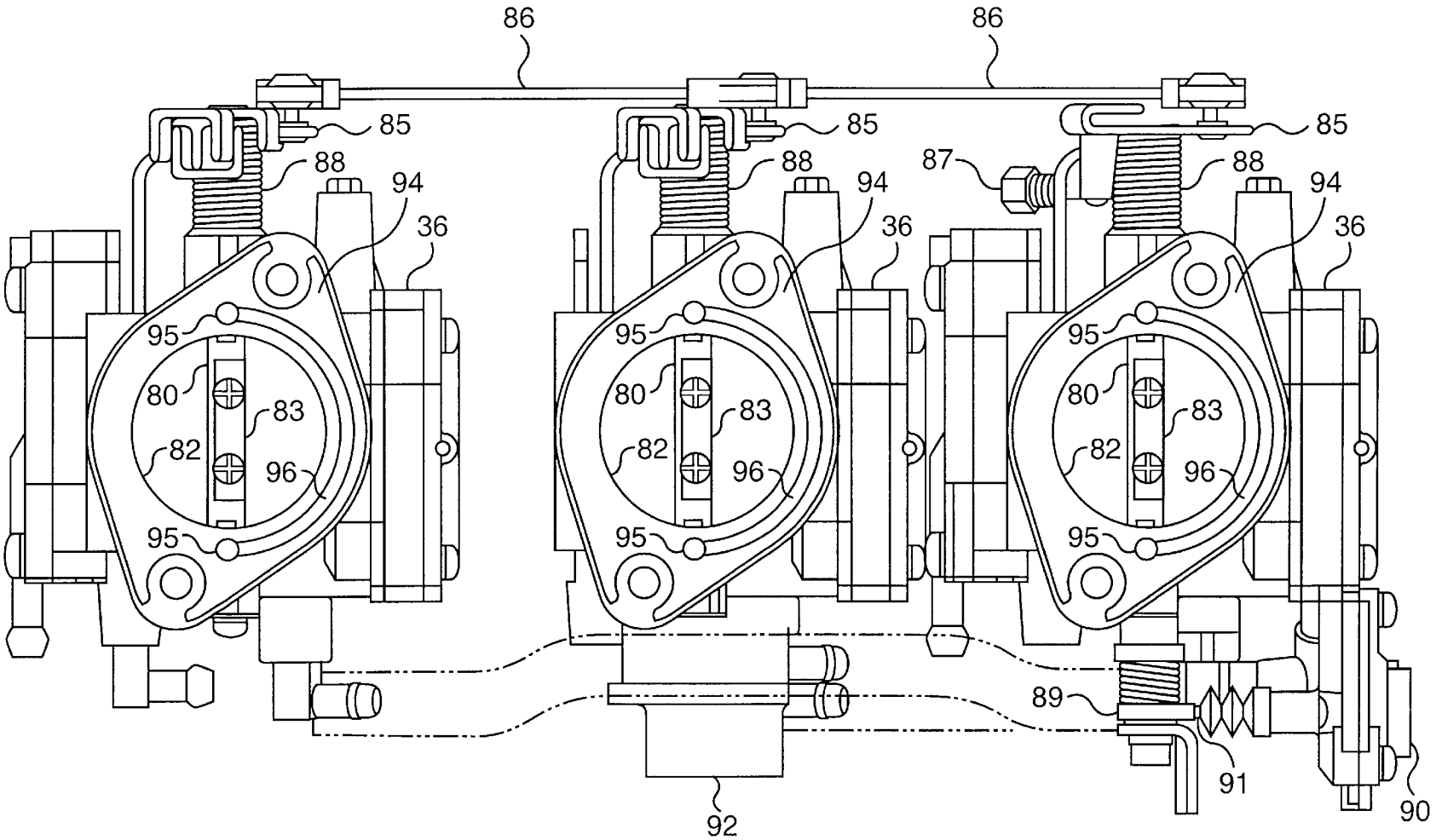
FIG. 6 is a bottom view of the carburetors, observed in the direction of arrow C in FIG. 5.

A total of three carburetors 36 are provided for the three cylinders, and are arranged in parallel with one another similarly to the cylinders. Referring to FIG. 5 showing the engine structure viewed in the direction of arrow B in FIG. 4 and FIG. 6 showing the structure viewed in the direction of arrow C in FIG. 5, each carburetor 36 is arranged with its throttle shaft 80 extending in a direction orthogonal with the juxtaposed direction of the cylinders. The throttle shafts 80 are independent from one another and are arranged in parallel. The carburetors 36 are spaced relatively close to one another, and are joined by a stay 79, thereby forming an integral carburetor unit.

Figure 7:
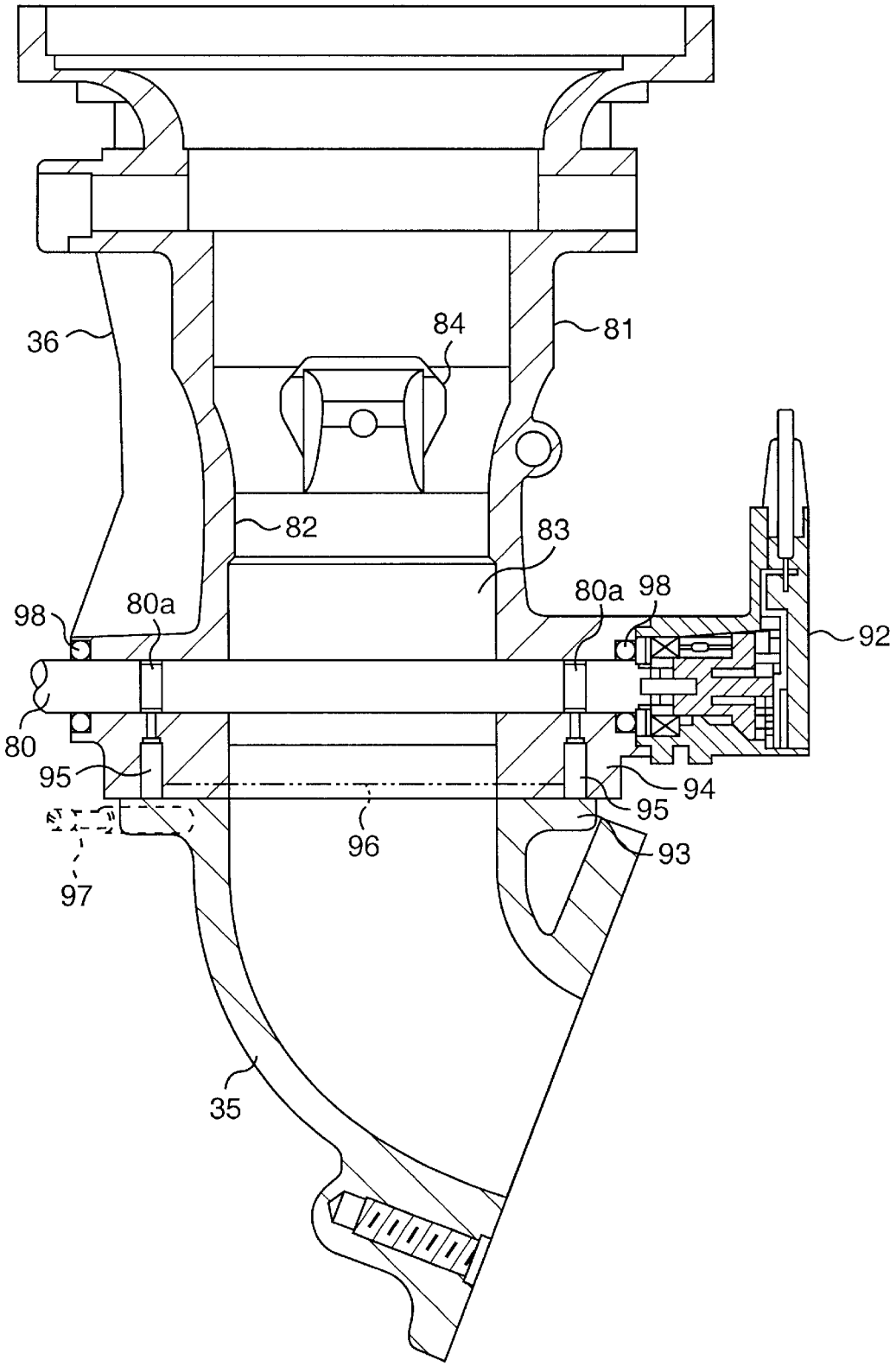
FIG. 7 is a longitudinal cross sectional view of a structure for attaching the carburetors.

As shown in FIG. 7, each throttle shaft 80 is rotatably supported by a carburetor body 81 with its one end extending outwardly from the carburetor body 81. A throttle valve 83 for adjusting a throttle opening amount is disposed at a position in the barrel passage 82 of each carburetor 36. Further, a venturi for injecting and spraying the fuel is provided in the barrel passage 82.

Each throttle shaft 80 is provided with a lever 85 at its other end. Adjacent levers 85 are mutually coupled by links 86. A throttle wire (not shown) is connected to one of the levers 85 via a stop screw 87 for adjusting the tension of the throttle wire. When the throttle wire is pulled in response to the throttle operation at the steering handle, the throttle shafts 80 are synchronously moved and displaced via the levers 85 and the links 86.

A return spring 88 is wound around each throttle shaft 80. When no tension is applied from the throttle wire during idling, for example, the return springs 88 urges the throttle shafts 80 to return to a moving position where the throttle opening is at a minimum.

One of the throttle shafts 80 has a cam 89 attached therewith at the end opposite to the end coupled to the link 86. An accelerating pump 90, attached to the carburetor body 81, is positioned near the cam 89. A piston rod 91 of the accelerating pump 90 has its one end in contact with the cam 89. When the cam 89 is moved together with the throttle shaft 80, the piston rod 91 is pushed backwards in order to activate the accelerating pump. A predetermined amount of fuel is stored in the accelerating pump 90. Therefore, when the throttle valve is opened in order to start the engine or to suddenly accelerate the jet boat, the accelerating pump 90 also supplies the fuel to the venturi 84, thereby optimizing the concentration of the air-fuel mixture generated by the carburetors 36.

The remaining throttle shaft 80 has a throttle sensor 92 attached to its end opposite to the end coupled to the link 86. The throttle sensor 92 detects the movement of the throttle shaft 80 (i.e., the throttle opening) in order to control the operation of the engine.

In this embodiment, the throttle shafts 80 of the respective carburetors are arranged in parallel with one another, which facilitates the arrangement of the accelerating pump 90 and the throttle sensor 92. Further, the carburetors 36 are housed in the relatively narrow space defined in the engine 9, and not only the links 86 but also auxiliary units such as the accelerating pump and the throttle sensor 92 are disposed on the side of the carburetor unit, which facilitates the maintenance work thereof.

As shown in FIGS. 6 and 7, the engine 9 is the two-cycle engine, in which the lubricating oil is not only supplied to the bearings of the throttle shafts 80, but is also mixed into the air-fuel mixture. For this purpose, each carburetor 36 is formed, on its flange 94 coupled to the intake manifold 35, with a pair of oil holes 95 that communicate with the bearings of each throttle shaft 80. Further, a dovetail groove 96 is formed on the flange 94 between the oil holes 95. The flange 93 of the intake manifold 35, coupled to the flange 94 of the carburetor, is provided with a lubricating oil plug 97. When the flanges 93 and 94 are coupled in a liquid-tight state and the carburetors 36 are attached to the intake manifold 35, an oil path is formed from the lubricating oil plug 97 to the bearings of the throttle shafts 80 via the dovetail grooves 96 and oil holes 95.

The bearings of the throttle shafts 80 are formed with peripheral grooves 80*a* at positions corresponding to the oil holes 95, which contribute to the overall lubrication of the bearings.

Oil sealing members are provided on the bearings outside the oil holes 95, so that the lubricating oil applied to the bearings of the carburetors 36 can reliably drip into the barrel passage 82 without leaking out of the carburetors 36.

The lubricating oil is supplied to the lubricating oil plugs 97 under the pressurized state via a pipe, not shown, and is forcibly supplied to the bearings of the throttle shafts 80 via the oil path constituted by the dovetail grooves 96 and the oil holes 95. Only surplus lubricating oil leaks from the bearings and drips into the barrel passage 82, and is supplied to the engine together with the air-fuel mixture.

The oil sealing members 98 on the outer surface of the bearings of the throttle shafts 80 prevent water from entering into the bearings. Further, the lubricating oil is forcibly supplied to the bearings, which is effective in preventing water from entering into the bearings via the barrel passage 82. Needless to say, lubricating oil layers are effective in preventing water from entering into the engine from outside.

Since the bearings of the throttle shafts 80 are sufficiently protected against water entering thereinto as described so far, the clearances of the bearings can be made small without fear that the water may enter thereinto. Thus, the carburetors 36 can reliably and precisely control the amount of fuel to be supplied to the engine. Further, it is possible to assure reliable emission control and to purify the exhaust gases.

The foregoing jet-propelled boat is driven by the operator who sits astride the seat 3 with his or her feet on the foot rests 7 and operates the steering handle 2.

Under the normal operation of the jet boat, except for operation at a low speed or under a low load, the exhaust control valves 40 maintain the exhaust ports 39 fully open. The engine repeatedly performs the two-stroke processes and rotates the impeller 13 at a high speed, as follows. The air-fuel mixture is supplied to the crankcase 23 from the carburetors 36 via the intake ports 33, is supplied to the combustion chambers via the scavenging ports 54 in response to the downward movement of the pistons 30, is compressed by the upward movement of the pistons 30, is ignited by the spark plugs 75, and is burnt. Burnt gases are then scavenged from the exhaust ports 39 in response to the downward movement of the pistons 30.

On the other hand, if the impeller 13 is rotated at a low speed or if it is stopped during idling (i.e., if the engine is operating at a low speed or under a low load), the exhaust control valves 40 substantially fully close the exhaust ports 39, and the engine 9 keeps on operating under the AR combustion, thereby improving the fuel economy and purification of exhaust gases at the low speed or under the low load.

When the throttle operation is performed in the foregoing state, the throttle shafts 80 are rotated in order to vary the opening extent of the throttle valves 83, so that an optimum amount of the air-fuel mixture is supplied to the engine 9.

In this state, the oil pump 70 is active, and supplies the lubricating oil, under pressure, to the bearings of the throttle shafts 80 from the lubricating plugs 97 via the dovetail grooves 96 and oil holes 95. Thus, the bearings of the throttle shafts 80 are lubricated by the lubricating oil, the throttle shafts 80 operate smoothly in response to the throttle operation, and the throttle opening is varied in a smooth state. Surplus lubricating oil supplied to the bearings of the throttle shafts 80 drips into the barrel passage 82, and is supplied to the engine 9 together with the air-fuel mixture.

The present invention is effectively applicable to carburetors of the foregoing small jet boats in which bilge water tends to enter into an engine room, or for carburetors of motorcycles which tend to be exposed to rainwater or the like. It is usually necessary to protect the engine against water entering thereinto so that the invention is also effectively applicable to carburetors for two-cycle engines.

Further, the invention is applicable to any two-cycle engines regardless of their structures and types, and does not require the exhaust control as an indispensable condition.

According to the present invention, the sealing members are attached to the bearings of the throttle shafts in order to maintain them in a liquid-tight condition, and the lubricating oil is forcibly supplied to the bearings via the oil holes which are present at the barrel passage inside the sealing members of the bearings. Lubricating oil films are formed on the bearings in order to lubricate the bearings, and prevent water entering into the engine via the bearings. Further, the lubricating oil is mixed with the air-fuel mixture, and is supplied to the two-cycle engine.

Further, in accordance with the invention, the oil holes are formed on the bearings supporting the opposite ends of throttle shafts, and communicate with one another via the dovetail grooves. The lubricating oil is forcibly supplied from one external source via the dovetail grooves, and can simultaneously lubricate the opposite ends of the bearings. This is effective in simplifying the lubricating oil supply system.

In the present invention, the lubricating oil supplied to the bearings of the throttle shafts is a separate oil type, and can simultaneously lubricate the bearings of the throttle shafts and various engine parts.

Further, the lubricating oil is supplied under pressure by the oil pump which varies the amount of lubricating oil in accordance with factors such as an engine speed, which is effective in lubricating the engine according to its operating state.

The invention being thus described, it will be obvious that the same may be varied as a departure from the spirit and scope of the invention, and all such modifications as would be obvious to one skilled in the art are intended to be included within the scope of the following claims.

What is claimed is:

1. A carburetor lubrication system for a two-cycle engine comprising: a throttle shaft;

bearings operatively connected to said throttle shaft to permit rotation of said throttle shaft;

sealing members operatively mounted relative to said bearings of said throttle shaft, said sealing members for preventing liquid from externally entering the bearings; and oil holes formed at positions near a barrel passage and inside the oil sealing members in order to forcibly supply lubrication oil to the bearings via the oil holes, said lubrication oil preventing liquid from entering into the bearings via the barrel passage.

2. The carburetor lubrication system according to claim 1, wherein the oil holes are formed for the bearings supporting opposite ends of the throttle shaft, a dovetail groove is formed on a flange of the carburetor for attachment to the engine, and one end of each of the oil holes communicates with the dovetail groove in order to forcibly supply lubricating oil from an external source and lubricate the bearings.

3. The carburetor lubrication system according to claim 2, wherein the lubricating oil is supplied from a separate supply oil and surplus oil from the bearings is mixed with an air-fuel mixture supplied to a combustion chamber via the barrel passage and is supplied to respective cylinders of the engine.

4. The carburetor lubrication system according to claim 2, wherein the lubricating oil is supplied by an oil pump which varies an amount of the lubricating oil in accordance with an engine speed.

5. The carburetor lubrication system according to claim 1, wherein the lubricating oil is supplied from a separate supply of oil and surplus oil from the bearings is mixed with an air-fuel mixture supplied to a combustion chamber via the barrel passage and is supplied to respective cylinders of the engine.

6. The carburetor lubrication system according to claim 5, wherein the lubricating oil is supplied by an oil pump which varies an amount of the lubricating oil in accordance with an engine speed.

7. The carburetor lubrication system according to claim 1, wherein the lubricating oil is supplied by an oil pump which varies an amount of the lubricating oil in accordance with an engine speed.

8. The carburetor lubrication system according to claim 1, wherein the oil holes are formed orthogonal to the throttle shaft and communicate directly with the bearings of the throttle shaft.

9. A carburetor lubrication system having a control valve for controlling the quantity of an air-fuel mixture supplied to a two-cycle engine comprising:

a throttle shaft;

bearings operatively connected to said throttle shaft to permit rotation of said throttle shaft;

sealing members operatively mounted relative to said bearings of said throttle shaft, said sealing members for preventing liquid from externally entering the bearings; and oil holes formed at positions adjacent to said sealing members and disposed to be adjacent to a barrel passage of said carburetor and inside the oil sealing members for supplying a lubrication oil to the bearings under pressure via the oil holes, said lubrication oil preventing liquid from entering into the bearings via the barrel passage.

10. The carburetor lubrication system according to claim 9, wherein the oil holes are formed for the bearings supporting opposite ends of the throttle shaft, a dovetail groove is formed on a flange of the carburetor for attachment to the engine, and one end of each of the oil holes communicates with the dovetail groove in order to supply lubricating oil under pressure from an external source and lubricate the bearings.

11. The carburetor lubrication system according to claim 10, wherein the lubricating oil is supplied from a separate supply oil and surplus oil from the bearings is mixed with an air-fuel mixture supplied to a combustion chamber via the barrel passage and is supplied to respective cylinders of the engine.

12. The carburetor lubrication system according to claim 10 wherein the lubricating oil is supplied by an oil pump which varies an amount of the lubricating oil in accordance with an engine speed.

13. The carburetor lubrication system according to claim 9, wherein the lubricating oil is supplied from a separate supply of oil and surplus oil from the bearings is mixed with an air-fuel mixture supplied to a combustion chamber via the barrel passage and is supplied to respective cylinders of the engine.

14. The carburetor lubrication system according to claim 13, wherein the lubricating oil is supplied by an oil pump which varies an amount of the lubricating oil in accordance with an engine speed.

15. The carburetor lubrication system according to claim 9, wherein the lubricating oil is supplied by an oil pump which varies an amount of the lubricating oil in accordance with an engine speed.

16. The carburetor lubrication system according to claim 9, wherein the oil holes are formed orthogonal to the throttle shaft and communicate directly with the bearing of the throttle shaft.

17. A carburetor lubrication system for a two-cycle engine comprising:

a throttle shaft;

bearings operatively connected to said throttle shaft to permit rotation of said throttle shaft;

sealing members operatively mounted relative to said bearings of said throttle shaft, said sealing members for preventing liquid from entering the bearings;

oil holes formed at positions near a barrel passage and inside the oil sealing member in order to forcibly supply lubrication oil to the bearings via said oil holes; and a dovetail groove formed on a flange of the carburetor for attachment to the engine, wherein one end of each of the oil holes communicates with the dovetail groove in order to forcibly supply lubricating oil from an external source and lubricate the bearings.

18. The carburetor lubrication system according to claim 17, wherein the lubricating oil is supplied from a separate supply of oil and surplus oil is mixed with an air-fuel mixture supplied to a combustion chamber via the barrel passage and is supplied to respective cylinders of the engine.

19. The carburetor lubrication system according to claim 17, wherein the lubricating oil is supplied from a separate supply oil and surplus oil is mixed with an air-fuel mixture supplied to a combustion chamber via the barrel passage and is supplied to respective cylinders of the engine.

20. The carburetor lubrication system according to claim 17, wherein the lubricating oil is supplied by an oil pump which varies an amount of the lubricating oil in accordance with an engine speed.

21. The carburetor lubrication system according to claim 17, wherein the lubricating oil is supplied by an oil pump which varies an amount of the lubricating oil in accordance with an engine speed.

* * * * *